United States Patent [19]

Waite et al.

[11] Patent Number: 4,931,091

[45] Date of Patent: Jun. 5, 1990

[54] TREATMENT OF MOLTEN LIGHT METALS AND APPARATUS

[75] Inventors: Peter D. Waite; Ghyslain Dube, both of Jonquiere, Canada

[73] Assignee: Alcan International Limited, Montreal, Canada

[21] Appl. No.: 362,487

[22] Filed: Jun. 7, 1989

[30] Foreign Application Priority Data

Jun. 14, 1988 [CA] Canada ..... 569415

[51] Int. Cl.[5] ..... C22B 21/06; F27D 23/04

[52] U.S. Cl. ..... 75/680; 75/708; 266/212; 266/225; 266/235

[58] Field of Search ..... 75/93 E, 93 R, 68 R; 266/215, 217, 225, 235

[56] References Cited

U.S. PATENT DOCUMENTS

| | | | |
|---|---|---|---|
| 3,737,305 | 6/1973 | Blayden et al. | 75/68 R |
| 3,849,119 | 11/1974 | Bruno et al. | 75/68 R |
| 3,870,511 | 3/1975 | Szekely | 75/68 R |
| 4,144,054 | 3/1979 | Stary et al. | 75/93 R |
| 4,159,104 | 6/1979 | Dantzig et al. | 75/93 E |
| 4,357,004 | 11/1982 | Pelton | 266/225 |
| 4,426,068 | 1/1984 | Gimond et al. | 266/217 |
| 4,634,105 | 1/1987 | Withers et al. | 266/217 |

*Primary Examiner*—Melvyn J. Andrews

*Attorney, Agent, or Firm*—Cooper & Dunham

[57] ABSTRACT

An apparatus and process are described for treating molten metal. The invention comprises: (a) a heated vessel having inlet and outlet means for the continuous flow of molten metal downwardly through the vessel, (b) a perforated plate extending horizontally across the vessel dividing it into an upper treatment section and a lower treatment section, this plate forming an intermediate treatment section, and (c) a device for injecting gas in the form of small discrete bubbles into the metal in the lower treatment section, this device comprising a hollow rotatable shaft extending downwardly through an opening in the plate with drive means coupled to the upper end of the shaft, a vaned rotor fixedly attached to the lower end of the shaft within the lower treatment section, with one or more passageways within the rotor for conducting gas from the interior of the shaft to the metal in the lower treatment section. When the gas is discharged through the rotor and the rotor is rotated, the gas is injected into the metal in the form of small discrete bubbles which are uniformly dispersed within the lower treatment section. In a preferred embodiment of the invention the gas bubbles move from the rotor upwardly and outwardly in a generally conical pattern to be distributed across the bottom of the perforated plate and pass upwardly through the perforations thereof.

25 Claims, 3 Drawing Sheets

TREATMENT OF MOLTEN LIGHT METALS AND APPARATUS

BACKGROUND OF THE INVENTION

This invention relates to refining of molten metal, and more particularly, to a method and apparatus for removing dissolved gases and other soluble and insoluble impurities from molten aluminum and its alloys.

Molten aluminum, prior to casting, contains many impurities which, if not removed, cause high scrap loss in casting, or otherwise result in poor quality metal products. Typical undesirable impurities requiring removal include dissolved hydrogen, alkali or alkaline earth elements and undissolved non-metallic inclusions.

The injection of inert or reactive gas mixtures into molten aluminum is a commonly used technique for the removal of the above impurities. The rate at which these impurities are removed depends to a great extent on how the fluxing gas is injected into the molten metal. Optimum performance in this type of metal treatment process is achieved when fine gas bubbles are generated creating a large interfacial contact area for the metal treatment reactions to occur, and when these gas bubbles are distributed in a uniform fashion throughout the entire cross-sectional area available for metal flow.

Processes are known in which a rotating impeller is used to inject gas into a body of molten metal without the use of a filter bed. The function of the impellers used in these processes is to generate small gas bubbles, and to distribute them uniformly throughout the entire volume of metal to be treated, or to set up a metal flow pattern such that all of the metal to be treated passes through some portion of the rotating impeller. Processes of that general type are described in U.S. Pat. Nos. 4,634,105; 4,426,068; 4,357,004; 3,870,511; 3,849,119; 3,839,019; 3,767,383 and 3,743,262. These general processes are optimised for the removal of dissolved impurities. They also have some beneficial effect on metal cleanliness by removal of undissolved particulate impurities, or inclusions primarily by flotation. However, reliability of such processes for inclusion removal is variable, due to turbulence on the surface of the treated metal associated with the rotating impeller. Such turbulence tends to re-entrain the inclusions as well as floating dross.

It is known to utilize gas-liquid countercurrent flow within a solid packed bed system to remove non-metallic impurities and hydrogen from molten aluminum. In these systems, the removal of non-metallic inclusions from molten aluminum relies on a countercurrently flowing gas mixture which serves to de-wet the inclusions from the molten metal and improves the filtration efficiency by accumulating the inclusions in the dross layer at the liquid surface. Gas injection typically takes place through a static injection device. Such systems are described in U.S. Pat. Nos. 4,383,888; 3,737,304; 3,373,303 and 3,707,305.

The above mentioned countercurrent gas flow systems have two main disadvantages. Firstly, they are not very efficient for the production of fine, evenly distributed gas bubbles in liquid metals. This is particularly the case in liquid aluminum due to its high surface tension. In addition, the poor wettability of most common refractories by aluminum increases the difficulty of producing a finely dispersed gas-liquid system. When large gas bubbles form, they tend to coalesce as they percolate through the bed, causing high local turbulence, uneven gas-liquid flow distribution, and possibly agitation of the bed itself.

Operational experience with the process disclosed in U.S. Pat. No. 3,737,305 shows that inclusion removal does not require large volumes of treatment gas. Typical treatment gas flow rates used in the process are in the range of 0.20 to 0.30 liters per kg of aluminum treated. The principal concern for inclusion removal is that the treatment gas is equally distributed across the entire fixed bed.

Efficient hydrogen removal, however, typically requires treatment gas flow rates in the range of 0.60 to 0.80 liters/kg. This is a major point of difficulty for processes which utilize static gas injectors beneath a fixed bed. Thus, at the higher gas flow rates required to effect dissolved hydrogen removal, without the turbulent shearing forces provided by a rotary gas injector, the treatment gas bubbles are large and not evenly distributed. Agitation and/or displacement of the fixed bed occurs which reduces significantly the inclusion removal efficiency, and increases dross formation and metal splashing, both of which are undesirable. The maximum practical treatment gas flow rate is limited to relatively low values. Operating conditions listed in U.S. Pat. No. 3,737,305 are a metal flow rate of 800 lb/hr (363 kg/hr) and a metal flow density in the fixed bed of 12 lb/hr/in$^2$ (equivalent to a bed area of 666.7 in$^2$ or 4300 cm$^2$). The gas flow rates are 40 SCFM (18.9 l/min) argon and 1 SCFM (0.47 l/min) chlorine. This is equivalent to 0.32 liters of treatment gas per kg of metal treated and is equivalent to 0.0045 liters/cm$^2$ bed/min. It is known that treatment gas flow rates in excess of this value tend to displace the fixed bed for the previously stated reasons.

There is a need for a process which can inject a sufficient volume of treatment gas into a body of molten aluminum below a solid packed bed to remove dissolved hydrogen without unacceptable bed agitation.

Secondly, it is difficult to maintain the gas injectors. Broken or plugged gas injectors can usually only be removed by shutting down the filtration process, and disassembling the filter bed. This is a difficult and expensive procedure, and as a result, the replacement of malfunctioning gas injection equipment is not always carried out with the necessary frequency.

It is an object of the present invention to provide an effective filtration and degassing system in a single unit, which will be more efficient than the prior systems.

SUMMARY OF THE INVENTION

The present invention in its broadest aspect relates to an apparatus for treating molten metal comprising in combination: (a) a heated vessel having inlet and outlet means for the continuous flow of molten metal downwardly through the vessel, (b) a perforated plate extending horizontally across the vessel dividing it into an upper treatment section and a lower treatment section, this plate forming an intermediate treatment section, and (c) a device for injecting gas in the form of small discrete bubbles into the metal in the lower treatment section, this device comprising a hollow rotatable shaft extending downwardly through an opening in the plate with drive means coupled to the upper end of the shaft, a vaned rotor fixedly attached to the lower end of the shaft within the lower treatment section, with one or more passageways within the rotor for conducting gas from the interior of the shaft to the metal in the lower treatment section. When the gas is discharged through the rotor and the rotor is rotated, the gas is injected into the metal in the form of small discrete bubbles which are uniformly dispersed within the lower treatment section. In a preferred embodiment of the invention the gas bubbles move from the rotor upwardly and outwardly in a generally conical pattern to be distributed across the bottom of the perforated plate and pass upwardly through the perforations thereof.

The invention also relates to a process for treating molten metal comprising the steps of: (a) passing a stream of molten metal downwardly through a heated refractory vessel containing an upper quiescent zone, an intermediate flow modifying zone in the form of a perforated plate extending horizontally across the vessel and a lower turbulent zone, (b) providing a gas injection device submerged in the molten metal in the lower turbulent zone comprising a hollow vertical drive shaft extending through said perforated plate with a vaned rotor fixedly attached to the lower end thereof and gas discharge passageways connecting the hollow portion of the drive shaft to openings between the rotor vanes, (c) introducing a gas into the upper end of the hollow drive shaft under sufficient pressure to be injected in to the molten metal between the rotor vanes, (d) sub-dividing the gas into small discrete bubbles by rotating the vaned rotor at a speed sufficient to create a circulation pattern in the molten metal such that the gas bubbles are transported away from said rotor and are uniformly dispersed within the lower treatment section.

In order to have the bubbles move in an upwardly and outwardly direction, the spaces between the rotor vanes are preferably open at the bottom and closed at the top. The top closures may either be portions of the rotor itself or the rotor may simply sit snugly beneath a fixed sleeve which carries the rotatable shaft of the rotor. In this manner, the bottom end of the sleeve serves as an effective closure for the top ends of the spaces between the rotor vanes.

The rotor is designed to (a) provide sufficient turbulence and shear forces to generate small gas bubbles and (b) transfer mechanical energy into the liquid metal to create bulk movement of the metal. The gas bubbles generated will thus be entrained by the metal circulation and carried away from the rotor.

The preferred shape of this gas distribution is conical, whereby the gas bubbles move away from the rotor in a generally upward and outward direction. This achieves a uniform distribution of gas bubbles across the bottom of the perforated plate. The shape of the gas bubble distribution is determined by a balance between the buoyant forces acting on the gas bubbles and the mechanical forces transmitted to the metal as a result of rotor rotation. These buoyant forces act on the gas bubbles, causing vertically upward oriented movement along the central axis of the turbulent zone of the metal treatment chamber. Liquid metal is entrained and bulk metal circulation is thus established. It is important that the design of the rotor be such that the establishment of this buoyantly driven metal circulation is not inhibited.

The vertically oriented, buoyantly driven metal flow in combination with the angular mixing action of the rotor results in the establishment of a toroidal metal flow field. Gas bubbles formed by the rotor are entrained by this bulk metal flow and carried away from the rotor. Subsequent bubble de-entrainment leads to the desired conical shape distribution. Thus, uniform gas flow through the perforated plate is achieved, while liquid metal in the region below the rotor is substantially free of gas bubbles.

The rotor vanes act to provide sufficient mixing of the metal bath into which the gas bubbles are distributed and to supply the level of turbulence and shearing forces necessary to generate small gas bubbles. The open spaces between the vanes aid in the formation of small gas bubbles by turbulently mixing the gas and metal phases. The spaces between the rotor vanes are preferably open at the bottom and closed at the top. The top closures may either be portions of the rotor itself or the rotor may simply sit snugly beneath a fixed sleeve which carries the rotatable shaft of the rotor. In this manner, the bottom end of the sleeve serves as an effective closure for the top ends of the spaces between the rotor vanes.

The above configuration with the open bottoms and closed tops is preferred because (a) the closed top ends of the spaces between the vanes inhibit vortex formation and (b) the rotor design is compatible with and does not inhibit the buoyantly driven metal flow. In the region where the rotating nozzle is situated, the buoyantly driven metal flow is directed vertically upward. The spaces between the rotor vanes are thus open at the bottom to allow free and unhindered access of the flowing metal into the mixing zones between the rotor vanes.

The metal thus travels upwardly through the mixing zones of the rotor and encounters the gas. Turbulent two phase mixing occurs. As the metal and finely divided gas phases travel upwardly through the mixing zones of the rotor, they encounter the top closed end of the mixing zones at which poit the mixture is accelerated outwardly. As the two phase mixture travels across the outer edge of the vanes, additional shearing assures that sufficiently small gas bubbles are formed. Thus, upon rotation of the nozzle, a mechanical pumping action contributes to and enhances the buoyantly driven metal flow. This ensures that the desired toroidal metal flow pattern is established independent of the magnitude of the buoyant force, which in turn depends on the treatment gas flow rate. This enables adjustment of the treatment gas flow rate with respect to the metallurgical process requirements while always maintaining the desired conical gas distribution.

By circulating the metal through the mixing zones of the rotor in the above manner, the treatment gas is efficiently carried away from the nozzle mixing zones. This allows the required treatment gas flow to be achieved and dispersed by a relatively small rotor, without excessive accumulation of gas in the mixing zones of the rotor (known as flooding) whereby insufficient metal enters the mixing zone of the reactor, resulting in less efficient bubble formation which creates larger gas bubbles.

The function of the perforated plate is to provide an intermediate zone which isolates the turbulent lower zone from the quiescent upper zone. Turbulence on the surface of the molten metal is suppressed, dross formation minimized and re-entrainment of floating inclusions and dross prevented.

According to a preferred embodiment of the invention, a bed of inert granular ceramic or refractory particles is positioned on top of the perforated plate, this bed and the supporting perforated plate together forming an intermediate treatment section. The perforations in the plate comprise about 25 to 45% of the surface area of the plate and the perforation diameters should be no longer than the average size of the particles immediately adjacent the top surface of the plate.

The perforations are preferably in the form of vertical openings which are advantageously upwardly tapered. The particles in the supporting bed typically have sizes in the range of 3 to 25 mm and these particles are preferably substantially spherical.

The rotor is preferably formed of a monolithic ceramic body, the material properties of which must be appropriate to resist chemical and thermal degradation due to long term exposure to the molten metal. It may, for instance, be formed from silicon carbide, alumina, graphite, etc. The vanes of the rotor are conveniently aligned vertically, but they may be inclined to the vertical at an angle of up to 45° with the direction of rotation of the rotor being such that the direction of flow of the bubbles of gas has an upwards component. The rotor vanes preferably have a ratio of axial length to radial width of about 1–5:1 and preferably 4–6 vanes are used.

According to another preferred feature of the invention, the outer diameter of the rotor vanes is sufficiently small that the entire rotor can be withdrawn vertically together with the shaft and sleeve through the perforated plate. In order to permit this, the maximum rotor diameter is no more than twice that of the shaft. This greatly simplifies maintenance of the rotor.

As mentioned above, the treating vessel of the invention includes an upper treatment section, a lower treatment section and an intermediate treatment section. The upper treatment section is essentially a two phase quiescent zone which allows the incoming metal to distribute evenly across the entrance to the intermediate zone and also provides a free metal surface permitting quiet escape of the gas and reduced dross formation. Dross which is formed can be skimmed without disturbing the fixed bed or perforated plate.

The intermediate treatment section is a three phase flow modifying zone. The principal function of this zone is to aid in gas-liquid contacting. Thus, the perforated plate and any fixed bed present act to equalize the flow of both the gas and liquid metal as they pass countercurrently. Each unit mass of metal is therefore contacted by the same volume of treatment gas, with untreated metal due to short circuiting being eliminated. This increases the performance and reliability of the metal treatment.

While allowing two phase countercurrent flow to take place, the perforated plate and any fixed bed thereon effectively isolate the well mixed turbulent zone below from the quiescent zone above. Small gas bubbles necessary for efficient metal treatment can thus be generated by the rotor with the required level of turbulence, while at the same time, maintaining a calm metal surface where the dross and floated inclusions can accumulate without being remixed back into the metal as would occur if the free metal surface were highly turbulent. Commercially available inline degassing/-fluxing processes which utilize rotary type gas injectors/dispersors typically have low, and highly variable inclusion removal efficiency, due in part to the turbulent metal surface.

The treatment gas which may be used in the process of this invention is any gas which is non-reactive toward liquid aluminum, with argon or nitrogen being preferred.

A reactive component may be added to the treatment gas to remove alkali/alkaline earth impurities as well as to aid in the flotation process for inclusion removal. In this system, the non-reactive treatment gas serves to remove dissolved hydrogen and acts as a carrier for the reactive component. The reactive component of the treatment gas may be chlorine, a gaseous mixture containing fluorine or a mixture of the two. Examples of a suitable fluorine containing gas are silicon tetrafluoride and sulphur hexafluoride. The proportion of reactive gas mixture to inert carrier gas can vary quite widely depending upon the amount of alkali and alkaline earth impurities to be removed. However, the reactive gas is usually present in the gas mixture in amounts of less than 10% by volume.

Significant advantages have been realized by the use of the process of this invention over prior filtration/inclusion removal processes which employ a fixed bed. Thus, before a given cast begins, the treatment gas flow rate and rotor speed can be adjusted to desired levels. This initiates a period of conditioning which serves to eliminate inclusions in the metal held in the system between casts, as well as to homogenize the metal temperature. The flushing out of inclusions and temperature fluctuations are commonly observed to occur at the beginning of a cast when other in-line filtration processes are used.

The process of the invention permits a sufficient volume of treatment gas to be injected into a body of molten aluminum below a solid packed bed to remove dissolved hydrogen without unacceptable bed agitation. Up to one liter of treatment gas per kg of metal treatment can be injected with no problems of bed agitation or displacement. This provides a treatment gas flow density in the fixed bed in the order of 0.0375 liter/cm$^2$ bed/min. This is about eight times the treatment gas flow density that is typically used in prior processes such as that disclosed in U.S. Pat. No. 3,373,305 and allows very efficient hydrogen removal equivalent to in-line degassing processes such as that disclosed in U.S. Pat. No. 3,743,263.

BRIEF DESCRIPTION OF THE DRAWINGS

The invention is illustrated by way of example with reference to the drawings in which.

DESCRIPTION OF THE PREFERRED EMBODIMENT

Figure 1:
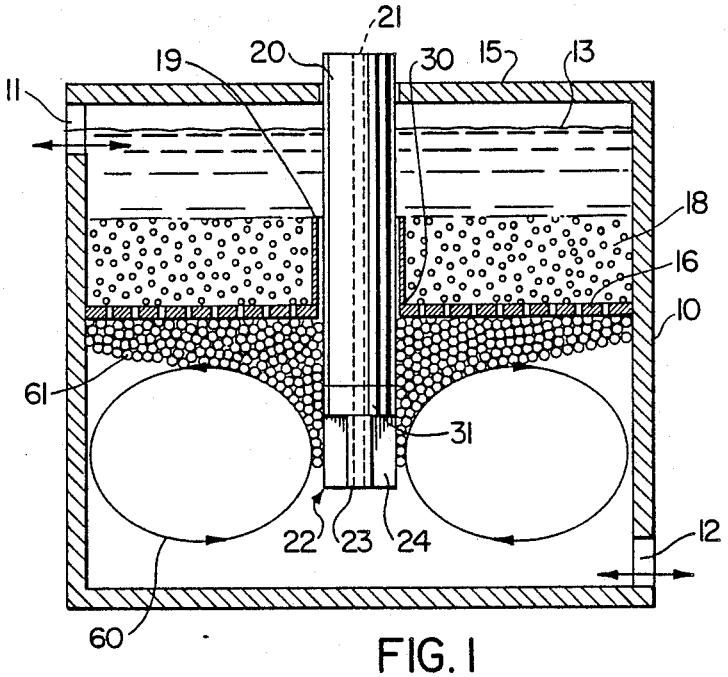
FIG. 1 is an elevation view in cross section schematically depicting the operation of the improved system according to the invention.

Referring now to FIG. 1, the system includes a containment vessel 10 constructed or lined with a suitable refractory material and provided with an inlet 11 and an outlet 12. The outlet 12 connects to a leg (not shown) which maintains the molten metal level 13. The top of the vessel is closed by means of a lid 15.

A perforated ceramic plate 16 extends entirely across the vessel dividing it into an upper treatment section above plate 16 and a lower treatment section below plate 16. This plate 16 itself comprises an intermediate treatment section together with any granular ceramic fixed bed 18 which may be placed on top of the plate. The system can be used with or without the fixed bed 18 on top of the perforated plate.

A hole 30 is provided centrally in plate 16 and mounted within this hole is a retaining sleeve 19, this serving to retain any granular ceramic fixed bed 18.

Extending through the sleeve 19 is a rotor assembly which includes a drive shaft 20 with an axial bore 21 which serves as a gas passage. Connected to the lower end of shaft 20 is a rotor 22 which consists of a central hub portion 23 with four radially projecting vanes 24. Slots 25 are provided in the bottom end of the hub portion 25 and these serve as passageways for gas to travel from gas passage 21 into the spaces 27 between the vanes 24. As will be seen from FIG. 2, these passageways 25 open into the inner sections of the spaces 27 between the vanes 24. The bottom ends of these spaces 27 are open, while the top ends are closed by top closure portion 31.

Figure 4:
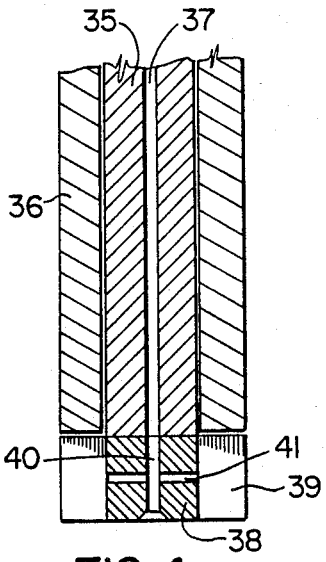
FIG. 4 is a sectional view of a further embodiment of the rotor.
Figure 5:
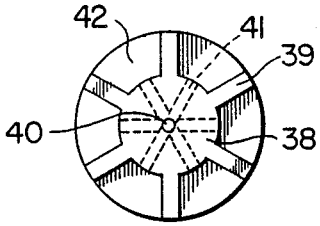
FIG. 5 is an end elevation of the rotor of FIG. 4.

A further embodiment of the rotor is shown in FIGS. 4 and 5. This embodiment includes a drive shaft 35 mounted for rotation within an annular sleeve 36, with the shaft having a gas passageway 37 extending axially therethrough. A rotor is connected to the bottom end of shaft 35 and this rotor includes a central hub portion 38 with six vanes 39 extending radially outwardly therefrom. The spaces 42 between the vanes are open at top and bottom. However, because the vanes 39 are located directly beneath the sleeve 36, as can be seen in FIG. 4, the bottom end of sleeve 36 effectively acts as a top closure for the spaces 42. The hub 38 includes an axial opening 40 which aligns with the axial opening 37 of drive shaft 35. Connecting laterally to opening 40 are four radial passageways 41 which connect the gas passage 40 to the spaces 42 between the vanes 39.

Figure 6:
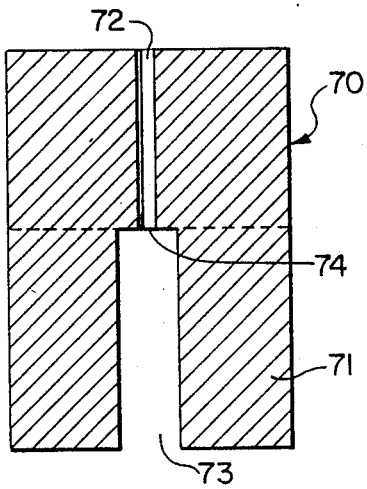
FIG. 6 is a sectional view of another embodiment of a rotor.
Figure 7:
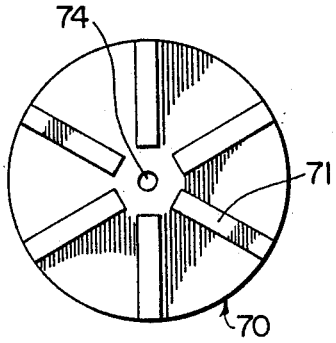
FIG. 7 is an end elevation of the rotor shown in FIG. 6.

A further embodiment of the rotor of the invention is shown in FIGS. 6 and 7. In this arrangement, the rotor has a main body portion 70 with six radial vanes 71 projecting downwardly from the main body portion. A cylindrical cavity 73 is formed between the inner edges of the vanes 71 and an axial bore 72 is provided in the main body portion 70 for gas injection. The gas discharges through an axial outlet 74 into the axial cavity 73. This rotor operates in the same manner as those described above with liquid metal flowing upwardly and outwardly between the vanes while picking up gas exiting from outlet 74.

Figure 8:
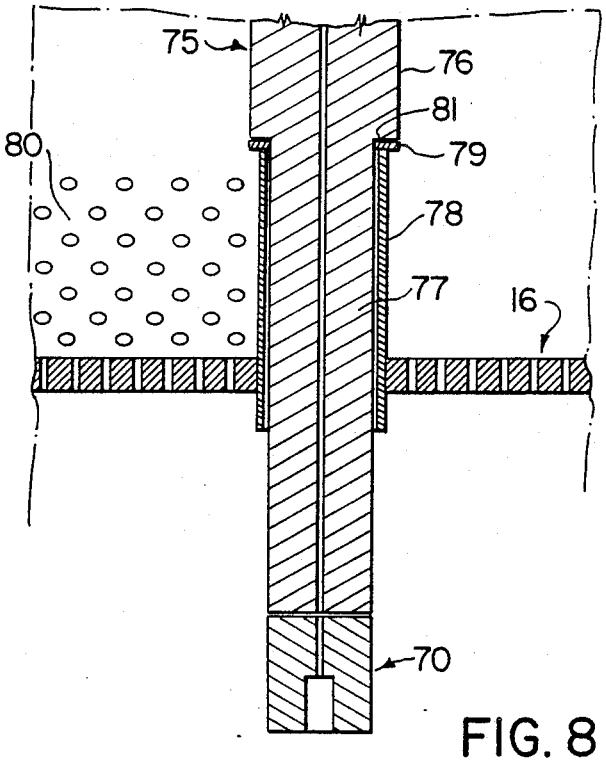
FIG. 8 is a sectional view of a rotor shaft.

A special arrangement of the drive shaft for the rotor is shown in FIG. 8. A sleeve 78 is fixed within an opening in the perforated plate 16 and this sleeve 78 preferably projects slightly above any fixed bed 80 provided on the perforated plate 16. If the top end of sleeve 78 is left open and is positioned below the maximum liquid metal level, then there tends to be a metal bypass from the upper treatment section into the lower treatment section of the apparatus. On the other hand, if the sleeve 78 is extended above the maximum liquid metal level in the upper treatment section, there tends to be a build-up of oxides on the surfaces of the tube which extend above the molten metal, causing maintenance and operational problems.

It is preferred to use a system as shown in FIG. 8 in which the shaft 75 has an upper section 76 of larger diameter and a lower section 77 of reduced diameter. An annular shoulder 81 is formed between the two diameters of the shaft. This shoulder 81 then sits on top of sleeve 78, preferably with a ring of compressible ceramic material 79, e.g. Fibrefrax® or Kaowool® which acts as a seal between the tube 75 and the sleeve 78. In this manner, the sleeve 78 supports the drive shaft 75 and metal bypass is eliminated.

As can be seen from the above embodiments, the diameter of the entire rotor assembly, including the rotor vanes, is such that the entire assembly can be pulled vertically upwardly through the perforated plate and removed for servicing.

Figure 9:
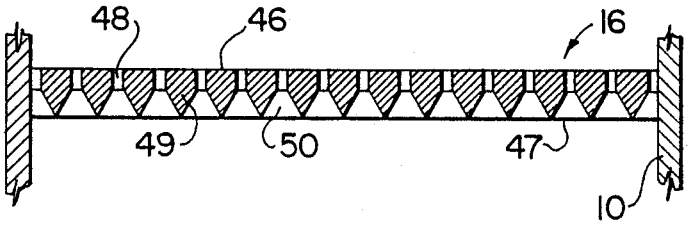
FIG. 9 is a sectional view of a perforated plate.

The perforated plate 16 is shown in greater detail in FIG. 9. Thus, the plate has a top face 46 and a bottom face 47 with a series of equally spaced holes 48 extending downwardly from the top face 46. The bottom portion of the plate includes inverted pyramid shaped portions 49 forming therebetween tapered entryways 50 for the openings 48. This facilitates the flow of gas bubbles through the openings 48.

Figure 2:
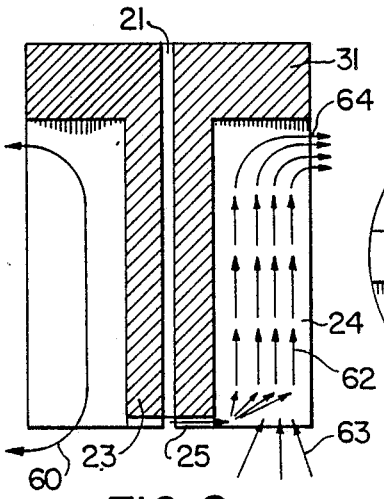
FIG. 2 is a sectional view of the rotor shown in FIG. 1.
Figure 3:
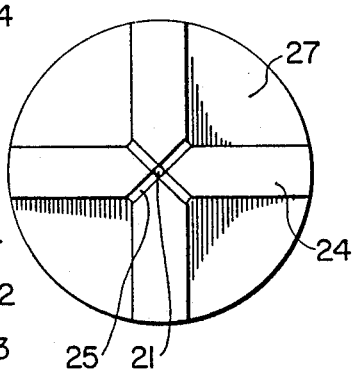
FIG. 3 is an end elevation of the rotor shown in FIG. 2.

The operation of the system of this invention can best be seen in FIGS. 1 and 2. The molten metal to be treated flows in through inlet 11 and into the upper 2-phase quiescent zone. This permits the incoming metal to distribute evenly across the vessel prior to moving downwardly. The molten metal then moves downwardly through the intermediate treatment section comprising the perforated ceramic plate 16 and any granular ceramic fixed bed 18. After passing through the perforated plate 16, the metal enters the lower turbulent zone where vigorous mixing takes place.

Treatment gas is discharged through outlets in the rotor 22 and into the spaces between the rotor vanes. The open spaces 27 between the vanes 24 aid in the formation of gas bubbles 61 by turbulently mixing the gas and metal phases and also function to initiate the bulk metal motion necessary to distribute the gas bubbles 61 to the desired conical pattern. Thus, as the gas bubbles travel upwardly through the mixing zones along paths shown by arrows 62, liquid metal is entrained via paths shown by arrows 63 and buoyantly driven flow is initiated. Since the top sections of the mixing zones are closed, with rotation of the rotor, the gas and metal in the top regions of the mixing zones are accelerated outwardly along paths shown by arrows 64. As the 2-phase mixture travels across the outer edge of the vanes, additional shearing assures that sufficiently small gas bubbles are formed. As a result of the vertically oriented, buoyantly driven metal flow, and the angular mixing action of the rotating nozzle, a toroidal metal flow field 60 is established. Gas bubbles are entrained by this bulk metal flow and carried away from the rotor. Subsequent bubble de-entrainment leads to the desired conical shape of gas bubble distribution. These gas bubbles are thereby uniformly distributed across the bottom of perforated plate 16 and easily pass upwardly through entryways 50 and vertical openings 48.

With this system, removal of hydrogen is accomplished by means of chemical transfer from the liquid metal to the ascending gas bubbles. Alkali removal is accomplished by reaction with the reactive component of the treatment gas bubbles. Non-metallic inclusions are removed by flotation, a process by which the inclusions are retained on the surface of the treatment gas bubbles and carried up to the free metal surface where they accumulate in the dross. The fixed bed 18 is being continually cleaned by the turbulent action of the gas bubbles. It will be evident that the number of gas bubbles generated, their size, shape and manner in which they are distributed into the metal are important factors in influencing the metal treatment performance. It will also be appreciated that the metal is being treated in all three zones of the vessel of the invention, from the point of gas bubble generation to where the treatment gas bubbles leave the treatment chamber at the free metal surface.

The perforated plate and fixed bed can be modified to suit the type of metal treatment desired. Increasing the thickness of the fixed bed tends to increase inclusion removal efficiency, but is not necessary for hydrogen or alkali removal. Thus a thick bed of, for example, greater than 25 cm. could be used if the product must be free of non-metallic inclusions. If hydrogen removal is of primary concern, the fixed bed could be substantially thinner, or eliminated entirely. The position of the perforated plate and fixed bed can be positioned high in the metal treatment chamber, the result of which is to substantially increase the volume of the lower turbulent zone, thus optimizing hydrogen and alkali removal. The size of the particulate material can also be adjusted. Fine material can be used to increase inclusion removal efficiency, at the expense of the effective life of the fixed bed.

EXAMPLE 1

A series of tests were carried out using the device shown in the drawings. Four different aluminum alloys were treated having Aluminum Association designations AA3004, AA5052, AA5182 and AA6201 and the percentages of hydrogen and alkali removed were determined.

The hydrogen was generally measured by Telegas Instrument, with one measurement being done by the sub-fusion measurement technique. The alkalis measured were total alkali/alkaline earth concentrations.

Processing conditions and results obtained are shown in Table 1 below:

TABLE 1

| Alloy | Argon flow rate (liter/min) | Chlorine flow rate (liter/min) | Metal flow rate (kg/min) | Hydrogen inlet (ml/100 g) | Hydrogen outlet (ml/100 g) | Percent Hydrogen Removal |
|---|---|---|---|---|---|---|
| AA5182 | 100 | 2.5 | 141 | 0.34 | 0.13 | 61.8 |
| AA3004 | 120 | 2.0 | 290 | 0.285 | 0.121 | 57.8 |
| AA5052 | 82 | 2.8 | 141 | 0.31 | 0.14 | 54.8 |
| AA6201 | 68 | 1.4 | 114 | 0.31 | 0.13 | 58.1 |
| AA5052 | 68 | 1.4 | 141 | 0.32 | 0.035(2) | 89.1 |

| Alloy | Inclusion(1) inlet ($mm^2/kg$) | Inclusion outlet ($mm^2/kg$) | Percent Inclusion Removal | Alkalis inlet (ppm) | Alkalis outlet (ppm) | Percent alkali Removal |
|---|---|---|---|---|---|---|
| AA5182 | 0.327 | 0.021 | 93.6 | 3.5 | 1.1 | 68.6 |
| AA3004 | 0.037 | 0.0037 | 90.0 | 4.94 | 1.16 | 76.5 |
| AA5052 | 0.6408 | 0.031 | 95.2 | 17.14 | 3.37 | 80.3 |
| AA6201 | 0.200 | 0.070 | 65.0 | 16.94 | 6.96 | 59.0 |
| AA5052 | 0.2263 | 0.0278 | 87.7 | 13.80 | 3.1 | 77.5 |

(1)Porous Disk Filtration Apparatus
(2)Sub-fusion measurement technique

We claim:

1. Apparatus for treating molten metal comprising in combination:

(a) a heated vessel having inlet and outlet means for the continuous flow of said metal downwardly through said vessel, (b) a perforated plate extending horizontally across said vessel dividing said vessel into an upper treatment section and a lower treatment section, said plate comprising an intermediate treatment section, and (c) a device for injecting gas in the form of small discrete bubbles into said metal in said lower treatment section, said device comprising a hollow rotatable shaft extending downwardly through an opening in said plate with drive means coupled to the upper end of said shaft, a vaned rotor fixedly attached to the lower end of said shaft within said lower treatment section, with one or more passageways within said rotor for conducting said gas from the interior of said shaft to said metal in said lower treatment section, whereby upon rotation of said rotor and provision of said gas flow, said gas is injected into said metal in the form of small discrete bubbles which move away from the rotor and are uniformly dispersed within the lower treatment section.

2. An apparatus according to claim 1 wherein the small discrete bubbles move away from the rotor upwardly and outwardly in a generally conical pattern to be distributed across the bottom of said plate and pass upwardly through the perforations thereof.

3. An apparatus according to claim 2 wherein the top ends of the spaces between the vanes of said rotor are closed.

4. An apparatus according to claim 2 wherein said shaft is rotatably mounted within a fixed sleeve which extends upwardly from the top end of the rotor through said perforated plate and into said upper treatment section.

5. An apparatus according to claim 4 wherein the bottom end of the sleeve serves as a closure for the top ends of the spaces between the rotor vanes.

6. An apparatus according to claim 2 wherein a bed of inert granular ceramic or refractory particles is positioned on top of said perforated plate, said plate and said bed together comprising said intermediate treatment section.

7. An apparatus according to claim 6 wherein the perforations in said plate comprise 25 to 45% of the surface area thereof, and the size of the perforations is no greater than the average size of said particles immediately adjacent the top surface of said plate.

8. An apparatus according to claim 2 wherein said perforated plate is a ceramic plate with a plurality of perforations extending vertically therethrough.

9. An apparatus according to claim 8 wherein said perforations are upwardly tapered.

10. An apparatus according to claim 6 wherein the particles comprising said bed have a size of 3 to 25 mm.

11. An apparatus according to claim 6 wherein the particles comprising said bed are substantially spherical.

12. An apparatus according to claim 3 wherein the vanes of said rotor are aligned vertically.

13. An apparatus according to claim 3 wherein the vanes of said rotor are inclined to the vertical at an angle of up to 45° and the direction of rotation of said rotor is such that the direction of flow of the bubbles of said gas has an upwards component.

14. An apparatus according to claim 12 wherein said passageways direct said gas to holes or slots for discharge of said gas into the spaces between said vanes of said rotor.

15. An apparatus according to claim 12 wherein said vanes have a ratio of axial length to radial width of 1 to 5:1.

16. An apparatus according to claim 12 wherein said rotor is provided with six vanes.

17. An apparatus according to claim 2 wherein said rotor is of a diameter which will permit movement thereof vertically through said opening in said plate.

18. A process for treating molten metal comprising the steps of:

(a) passing a stream of molten metal downwardly through a heated refractory vessel containing an upper quiescent zone, an intermediate flow modifying zone in the form of a perforated plate extending horizontally across the vessel and a lower turbulent zone, (b) providing a gas injection device submerged in the molten metal in the lower turbulent zone comprising a hollow vertical drive shaft extending through said perforated plate with a vaned rotor fixedly attached to the lower end thereof and gas discharge passageways connecting the hollow portion of the drive shaft to openings between the rotor vanes, (c) introducing a gas into the upper end of the hollow drive shaft under sufficient pressure to be injected in to the molten metal between the rotor vanes, (d) sub-dividing the gas into small discrete bubbles by rotating the vaned rotor at a speed sufficient to create a circulation pattern in the molten metal such that the gas bubbles are transported away from said rotor and are uniformly dispersed within the lower treatment section.

19. A process according to claim 18 wherein the gas bubbles are transported from said rotor upwardly and outwardly in a generally conical pattern which is distributed across the bottom of the perforated plate and pass upwardly through the perforations thereof.

20. A process according to claim 19 wherein said metal is aluminum or an alloy thereof.

21. A process according to claim 19 wherein said gas is an inert gas.

22. A process according to claim 19 wherein said gas is argon.

23. A process according to claim 19 wherein said gas is a mixture of inert and reactive gases.

24. A process according to claim 19 wherein said gas is a mixture of argon and chlorine, in a proportion of 1–10% chlorine and 99–90% argon.

25. A process according to claim 19 wherein said intermediate section comprises a bed of granular ceramic or refractory particles positioned on top of said plate and the gas bubbles which pass through the perforations of said plate move upwardly through the spaces between the solid particles of the bed.

* * * * *